US005355711A

United States Patent [19]

Chisum

[11] Patent Number: 5,355,711

[45] Date of Patent: Oct. 18, 1994

[54] VEHICLE LIFT AND SUPPORT HAVING CONNECTABLE BODY AND FRAME MEASURING AND STRAIGHTENING EQUIPMENT

[76] Inventor: Finis L. Chisum, Rte. 5, Box 267, Claremore, Okla. 74017

[21] Appl. No.: 936,137

[22] Filed: Aug. 27, 1992

[51] Int. Cl.[5] ..... B21D 1/12

[52] U.S. Cl. ..... 72/457; 72/705; 33/608

[58] Field of Search ..... 72/457, 705; 33/608

[56] References Cited

U.S. PATENT DOCUMENTS

| | | | |
|---|---|---|---|
| Re. 31,636 | 7/1984 | Chisum | 72/305 |
| 3,888,100 | 6/1975 | Chisum | 72/305 |
| 4,174,623 | 11/1979 | LeGrand et al. | 72/34 |
| 4,463,937 | 8/1984 | Celette | 269/17 |
| 4,534,200 | 8/1985 | Celette | 72/305 |
| 4,574,614 | 3/1986 | Field | 72/447 |
| B1 4,574,614 | 1/1992 | Field | 72/447 |
| 4,603,570 | 8/1986 | Dehn | 72/705 |
| 4,660,405 | 4/1987 | Widegren et al. | 72/705 |
| 4,731,936 | 3/1988 | Aldrich et al. | 33/608 |
| 4,848,136 | 7/1989 | Venalainen | 72/705 |
| 4,982,595 | 1/1991 | Fiorese | 72/705 |
| 5,058,286 | 10/1991 | Chisum | 33/608 |

*Primary Examiner*—Lowell A. Larson
*Attorney, Agent, or Firm*—Head & Johnson

[57] ABSTRACT

A multi-use vehicle support and lift for performing general repair and overhaul and to position a vehicle centrally on the support for measuring and then repairing collision damage using an attachable pulling tower.

9 Claims, 14 Drawing Sheets

VEHICLE LIFT AND SUPPORT HAVING CONNECTABLE BODY AND FRAME MEASURING AND STRAIGHTENING EQUIPMENT

BACKGROUND OF THE INVENTION

FIELD OF THE INVENTION

The present invention is a multi-use vehicle support and lift for lifting, positioning and measuring vehicles in order to repair collision damage or perform general repairs.

THE PRIOR ART

During the 1970's the United States automobile market was dominated by vehicles constructed with traditional framed chassis. Traditional frame construction uses a steel frame, usually under the vehicle, as a base to which the body and other components are affixed.

The middle of that decade witnessed many changes in the U.S. automobile market. The introduction and eventual explosion of unitized constructed vehicles led to greater competition between manufacturers. The technological improvements and consequent advantages of unitized construction in basic body design, the materials used, and the introduction of safety zones dramatically improved occupant safety. The ability of the foreign manufacturer to change a model's styling without the necessity of complete retooling was a major production advantage.

A variety of economic and regulatory factors forced the domestic manufacturers to move away from framed construction toward the unitized body in the late 1970's. By then most foreign manufacturers had perfected their production methods and had gained an increasing sales volume advantage over domestic manufacturers.

A more discerning public demanded increased active and passive safety in the automobile, and the uni-body constructed vehicle provided both.

In unitized constructed vehicles, the components of the inner and outer body function as the frame. A unitized constructed automobile body is produced with closer tolerances, and the main structure is constructed using high-strength low-alloy steel. Some manufacturers are beginning to use components of plastic for cosmetic panels. All these factors render the repair of the unitized constructed automobile extremely complex, even more so than the traditional repair techniques and processes required for full-framed vehicles. In many cases, less "power" is required by the body and frame alignment equipment to pull the unitized constructed vehicle back into alignment.

The move to the unitized constructed body by the domestic automobile industry and the inroads made in the U.S. market by foreign manufacturers have accelerated the need for multi-use products in the collision repair facilities. These products must have the versatility and adaptability to function not only as body and frame alignment repair systems for both unitized and frame cars, but also must be capable of being employed in other avenues of repair and service. Collision repair equipment must now provide convenience of work flow through the repair facility, more comfortable working heights for the technicians to increase their productivity, less movement of the cars through the shops during repair, and (because of the multi-use capabilities) must cut the equipment investment costs to the facility.

Overall economic conditions of the collision repair industry in the U.S. and other countries have produced a need for more versatile body and frame alignment equipment, equipment that can be used for purposes other than body and frame alignment, such as use as a car lift. In the last few years cars have become lighter in weight and smaller in size, making it all but impossible for a repair technician to do anything underneath or on the lower body section of the vehicle without raising the whole car up to a comfortable working height.

Prior lift devices have been constructed to accommodate portable pulling devices to be used to pull the frame and body into proper alignment when needed. In almost every instance, collision damaged vehicles must be raised one or more times during repair, although some may not need to be pulled with the pullers.

Lifts have also been constructed to accommodate measuring/gauging systems, such as described in U.S. Pat. No. 5,058,286. In the aforesaid patent, the lift jack incorporated in the vehicle supporting treadway or platform works to center the car relative to the treadway. Once centered, the platform is used as the basis for the measuring/gauging device.

All collision damaged vehicles do not have to be measured. For the ones that do require measuring, universal measuring is recommended by most (if not all) car manufacturers and other authorities. The measuring device can be attached to the platform system to measure any part of the vehicle when needed.

Further background for the invention is found in U.S. Pat. No. 5,058,286 dated Oct. 22, 1991, which is incorporated herein by reference. The patented universal measuring system is comprised of a built-in longitudinal measuring device which is controlled electronically from a three-way switch fixed to the outer perimeter of the platform. The width measurement device (when in use) is located on the upper milled surface of the platform, and is fitted with roller bearings allowing the entire assembly to be easily moved along the length of the platform. A machined V-groove controls and maintains the assembly in the required position. Height measuring assemblies are fitted at any location along the entire length of the width measuring device, and each assembly is fitted with two (2) bubble levels to ensure a perpendicular angle of measurement at each of the selected locations being measured. The calibrated measuring slide portion of each assembly is spring-loaded and is fitted with a universal location pointer to suit either factory manufactured holes, bolts or other locations. The base of the calibrated upright pointer assembly of each height measuring device is connected by a mechanical universal joint. This allows (unlike other available systems) the measuring system to remain in position when the vehicle is positioned on the platform and while the entire repair is being carried out. The system provides three-dimensional analysis of any vehicle (frame or uni-body construction) for both domestic and foreign automobiles.

SUMMARY OF THE INVENTION

It is an object of this invention to provide a versatile body and frame alignment machine capable of supporting and, as needed, measuring and correcting defects in vehicles resulting from collision. The apparatus comprises the following systems:

LIFT AND PLATFORM SYSTEM ASSEMBLY

A free-standing, scissors-type jack lift is provided to raise and lower a vehicle supporting platform and position the collision damaged vehicle at a desired height or to raise and lower a vehicle for general utility purposes in an automotive repair environment.

One platform embodiment has parallel treadways constructed of parallel steel "I" beams to support the vehicle in the treadways. Each I-beam is calibrated with measuring tape indicia across its width from the center line of the platform system in half-inch (½") or other dimensional increments for use in measuring and correcting the damaged vehicle. A plurality of parallel conduits are transversely connected to the I-beams of each treadway to provide structural support and means to receive mechanisms for pulling the vehicle back to its proper alignment as hereinafter described. On the inside of one main I-beam, a longitudinally movable measuring device (tape) is fitted. Movement is controlled electronically by a three-position switch located on the opposite outside main beam. The function of the longitudinal measuring device is described in detail in U.S. Pat. No. 5,058,286.

PULLING SYSTEM

A pulling system comprises a pulling tower (one or more) powered by a hydraulic piston located inside the pulling tower's vertical upright portion which acts to pull a chain or cable connected to the vehicle. It can be operated by a traditional hand pump or pneumatic electric or radio control means. The pulling system is anchored to the platform by means of a single pin received within one or more of the platform conduits and thus can be secured at any point (360 degrees) around the perimeter of the vehicle/platform. The pulling arm is angularly rotatable to a variety of adjustable positions through 190 degrees, and incorporates a device which reduces pull chain "chain slack" to a minimum. A chain location collar is fully adjustable through the entire height of the pulling arm, which acts to position the pull chain at a desired angle to the vehicle.

CENTERING AND LEVELLING DEVICE

A vehicle centering and leveling device is a separate mechanism connected to the platform system assembly when needed. The device is based on the principle that the body/chassis of most private passenger cars on the road are symmetrical. During original manufacture the automobile is held rigid in a level and central position on the assembly jigs. It is therefore critical, when structural repairs are being carried out, that the manufacturer's assembly techniques and measurements are followed as closely as possible. The principle of operation once the vehicle is placed upon the platform system assembly is as follows:

1. A centering means is located relative to the platform system assembly and is capable of moving the vehicle to a centered position on the platform; that is, to a position where the longitudinal center axis or central vertical plane of the vehicle is aligned with the longitudinal center axis of the platform system assembly. One means described herein includes a track located on the floor outside the platform system or between the treadway I-beams, if desired. The centering means acts to temporarily support the vehicle above the platform system assembly and to permit movement to the centered position hydraulically, mechanically, as by a cam means, or by human movement.
2. The platform is lifted by means of the lift to a final or desired height position.
3. Pinch-weld clamps supported on a pair of vehicular support bars are fixed in the required position to the sill panels of the vehicle.
4. The platform system assembly is raised to sufficient height to allow the centering stands to be placed under each end of the vehicular support bars.
5. The lift is lowered, leaving the vehicle resting on the vehicular support bars which are on top of the centering stands. When the vehicle's wheels clear the platform system assembly, the vehicle can easily be shifted forwardly or rearwardly from side-to-side or angularly by the centering means until centered on the platform system assembly. Means such as described in U.S. Pat. No. 5,058,286 may be used to 'fine-tune' the centering if needed.
6. After centering, the lift is raised and the vehicle is secured to the platform system assembly and the centering means is removed. The vehicle is now in position to be measured and corrected.

UPPER BODY MEASURING SYSTEM

For collision repair purposes, there is an upper body measuring assembly which enables the body repair technician to effect speedy and accurate assessment of upper body alignment at any selected point over the entire vehicle. Using the assembly allows the operator to accurately access the progress during repair. The principle of operation is as follows:

1. A measuring cross track device for measuring widths transverse to the longitudinal centerline is positioned onto a milled surface of the platform system assembly. For ease of movement, wheeled members connected to the measuring cross track travel in a V-groove machined longitudinally along an I-beam of the platform system assembly.
2. The device is positioned approximately under (and in line with) the location to be measured, using the opposite undamaged side or the manufacturer's specifications as a guide.
3. An upper calibrated, upper side body measuring device is fitted to the damaged side of the vehicle, being set at exactly the same width measurement noted from the opposite side.
4. A second calibrated upper side body measuring device is fitted to the damaged side of the vehicle, being set at exactly the same width measurement noted from the opposite side.
5. Calibrated measuring pointers are now fitted to both upper body measuring devices.
6. An overhead calibrated measuring device with calibrated measuring pointers is fitted between the two upper side measuring devices.
7. Measurements can now be taken on the undamaged component and transferred to the damaged component for comparison.

Using the complete universal measuring system (under-body, side-body, and upper-body) as heretofore described will provide most, if not all, the necessary information to complete the repair, with or without the supplied manufacturer's data/specification charts.

In addition to apparatus capable of lifting, centering, holding, measuring and repair, the apparatus of this invention will provide a multi-purpose service and repair lift permitting vehicles to be fully driven on and off for other services. For example, the platform will provide access for the removal of mechanical components such as engines, transmissions, suspension systems, etc. Other equipment for steering and wheel alignment is also applicable for use with the basic lift/platform system.

DETAILED DESCRIPTION OF THE PREFERRED EMBODIMENTS

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

Figure 1:
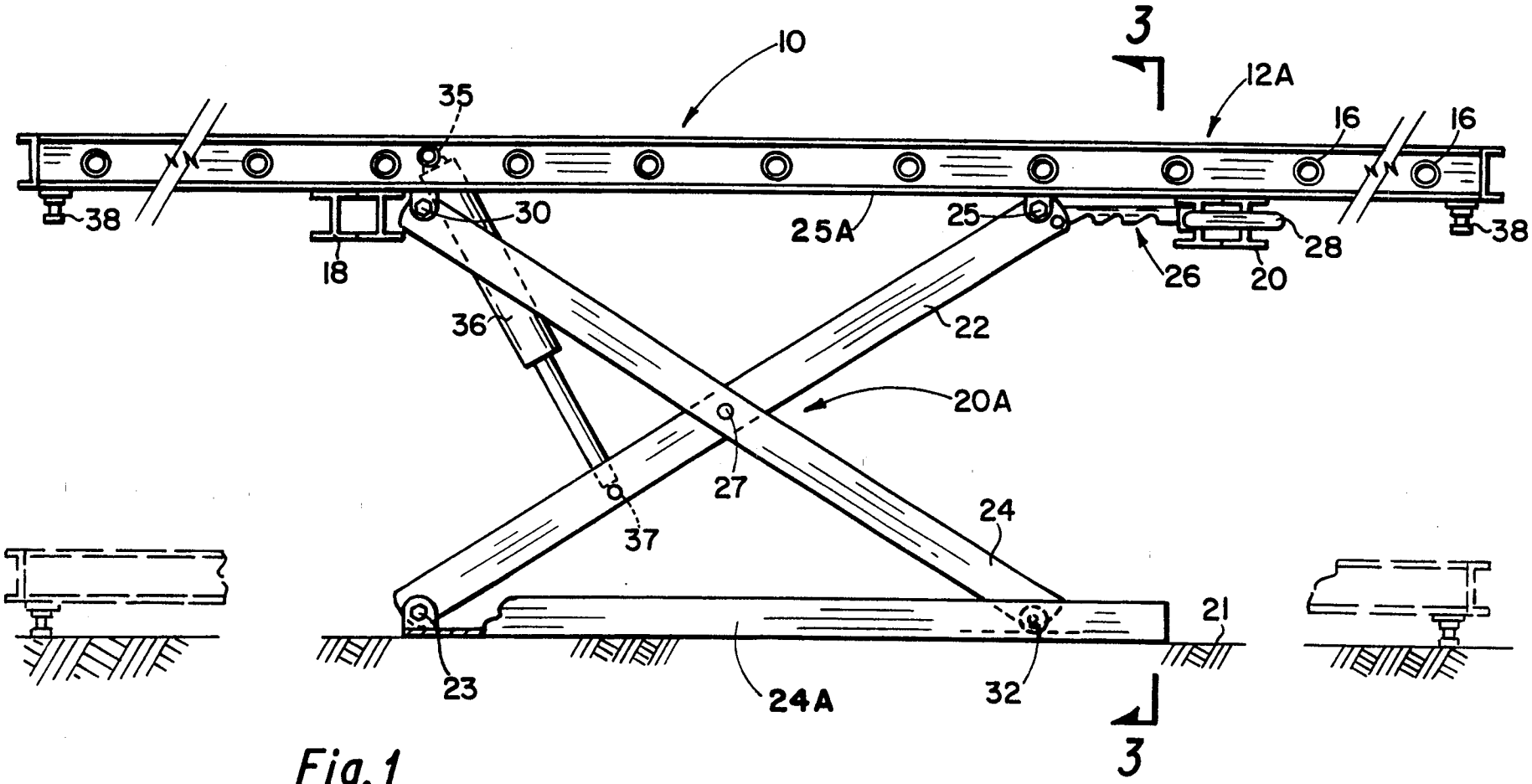
FIG. 1 is a side elevational view of the basic platform system assembly of this invention.
Figure 2:
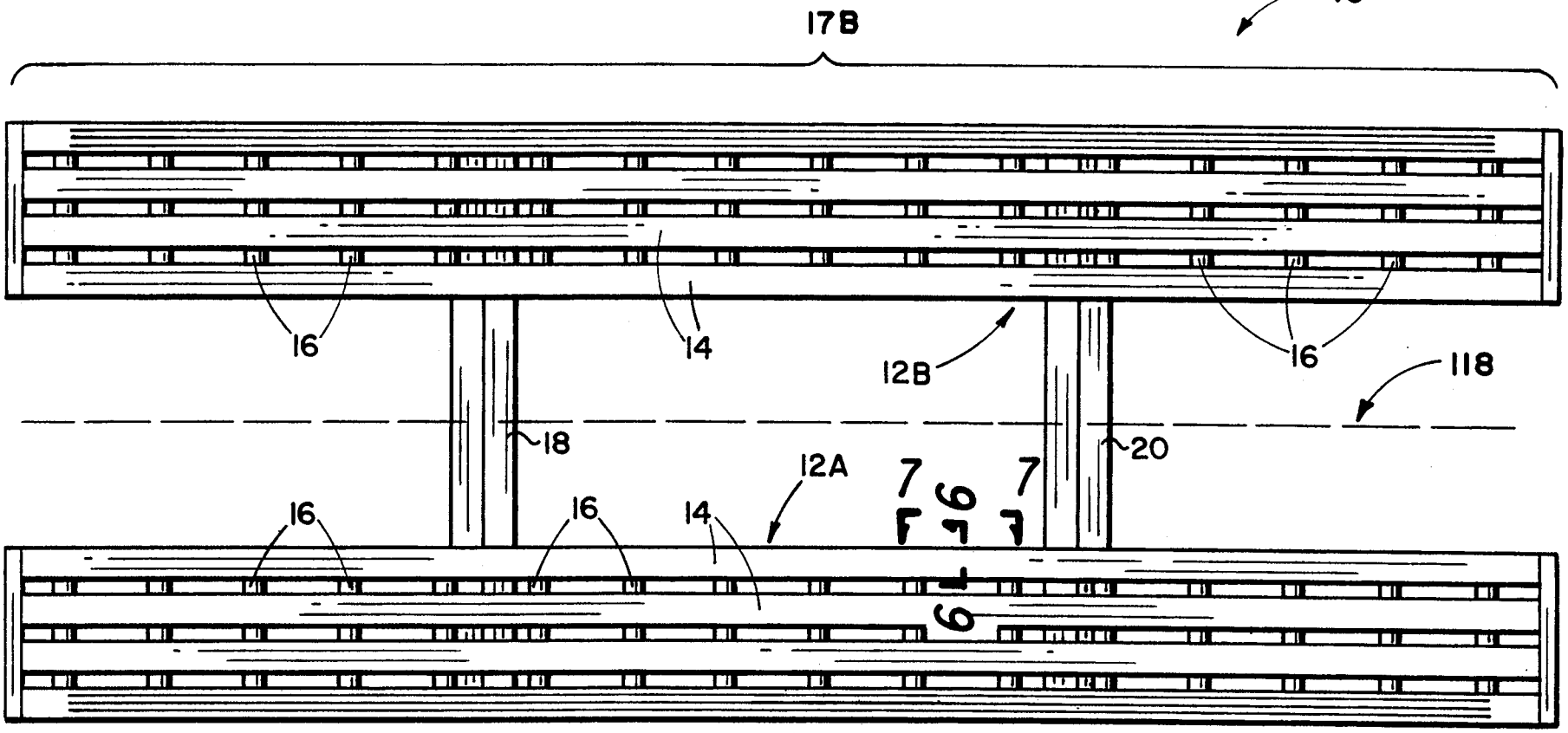
FIG. 2 is a top elevational view of the platform system assembly of FIG. 1.
Figure 4:
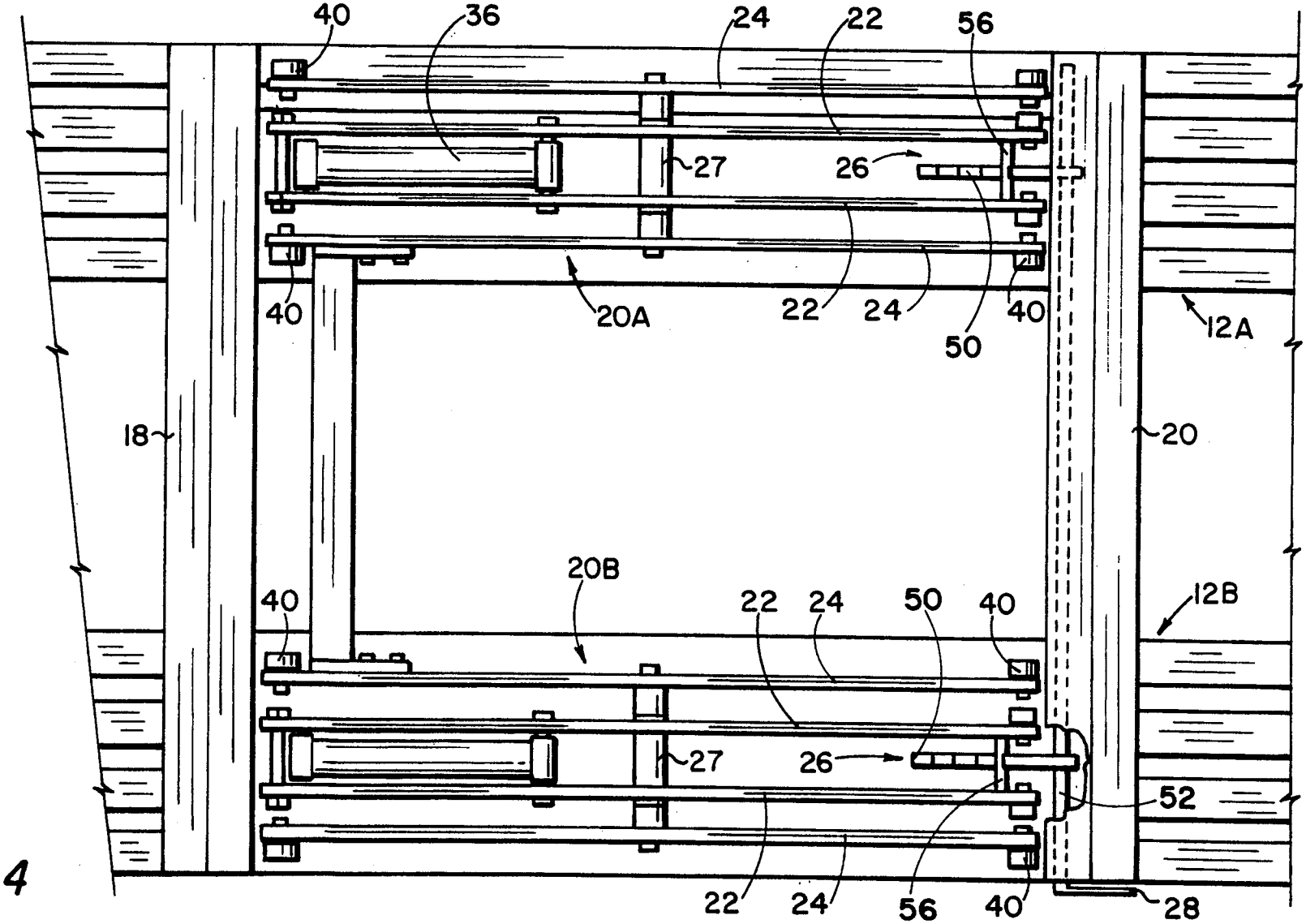
FIG. 4 is a bottom elevational view depicting the scissor-jack lift mechanism.
Figure 5:
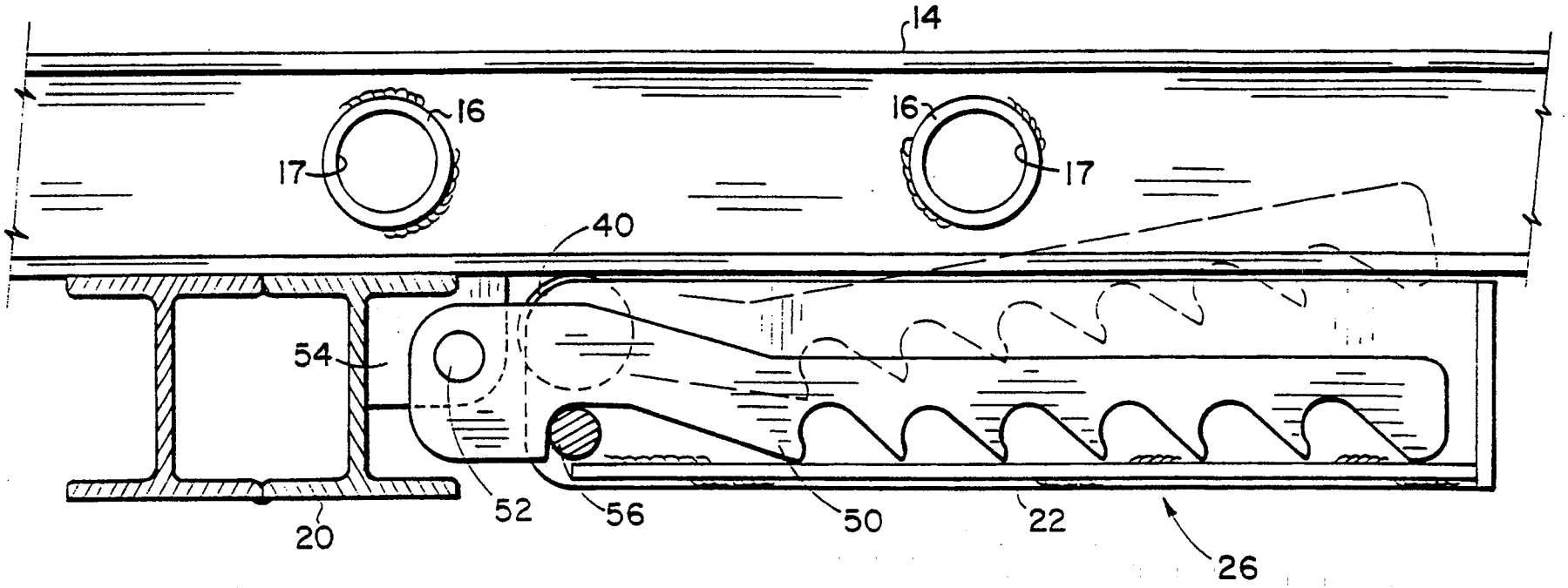
FIG. 5 is an enlarged view of the safety ratchet and locking device for positioning the platform in at a variety of vertical heights.

Referring now to FIGS. 1–5, the basic platform system assembly is generally designated by the numeral 10 and comprises right and left platform treadways 12A and 12B, each with an outer perimeter (see FIG. 2). Each treadway 12A and 12B is comprised of a plurality of parallel I-beams 14 which are interconnected by a plurality of transverse tubing 16 which open to the outer perimeters of the treadways 12A and 12B, providing conduits 17 for the pulling towers 210 hereafter described. These transverse tubing 16 and conduits 17 are spaced along a longitudinal length 17B of each treadway 12A and 12B. The parallel treadways 12A and 12B are interconnected by forward cross members 18 and rearward cross members 20. Scissor-type lift jacks, generally designated by the numerals 20A and 20B, are supported on a floor 21 by a support frame 24A. These scissor jacks, 20A and 20B, are utilized respective for right and left treadways 12A and 12B. Each jack comprises a pair of inner parallel lever arms 22, located adjacent to each other, and a pair of outer parallel lever arms 24 spaced apart so the inner arms 22 are located therebetween. One end of each arm 22 is connected to the support frame 24A at floor pivots 23. An opposite end 25 of each arm 22 is slidable along respectively a bottom 25A of platform treadway 12A and a bottom (not shown) of platform treadway 12B. The jacks 20A and 20B also include a ratchet-type locking system generally designated by the numeral 26 which is releasable by handle 28, the details of which are illustrated in FIG. 5.

One end of each outer parallel lever arms 24 is connected respectively to the bottom 25A of the platform treadways 12A and the bottom (not shown) of the platform treadway 12B at pivot points 30 while opposite ends 32 of each outer parallel lever arm 24 are slidable within the support frame 24A. One end 35 of a hydraulic actuated piston and cylinder 36 attaches to the right platform treadway 12A and the other end 37 attaches to the inner parallel lever arms 22. Similarly, another hydraulic actuated piston and cylinder 36 attaches to the left platform treadway 12B. The operation of the hydraulic actuated piston and cylinders 36 is adapted to raise and lower the platform treadways 12A and 12B between a lowered position, shown in FIG. 1 by the dotted lines, to a raised position, as also shown in FIG. 1 in the solid lines.

At each end of each treadway 12A and 12B is an adjustable bolt 38 which is adapted to level the platform system assembly 10 when it is on the floor 21 or with extensions (not shown) attached thereto for adjusting the level in the raised position. The scissor jack lever arms 22 and 24 are connected by a central pin 27. The ends 25 are provided with roller 40 which move along the bottom 25A of right treadway 12A and the bottom (not shown) of left treadway 12B whenever the platform system assembly 10 is raised or lowered. Likewise, the ends 32 are provided with rollers 40 which move within support frame 24A whenever the platform system assembly 10 is raised or lowered.

The safety ratchet-type locking system, generally identified by the numeral 26, is best shown in FIGS. 4 and 5 for each leveling jack 20A and 20B. Ratcheting lever arms 50 are pivoted about a shaft 52 which runs transverse across the platform treadways 12A and 12B and is supported by gusset plates 54 which attach to the rearward cross member 20. The ratcheting arms 50 are attached to shaft 52 and rotatable by lever handle 28, shown in FIG. 4 so as to be pivoted as shown by the dotted line in FIG. 5. As the platform system assembly 10 is being raised, the ratchet arm 50 will interlock with fixed transverse shaft 56 and thus provide a safety lock for the platform system assembly 10 at a variety of heights. To release the ratchet arm 50, the platform system assembly 10 will first be raised slightly, relieving the pressure upon the ratchet arm 50. Then, using handle 28, the ratchet arm 50 is raised as shown by the dotted line, allowing the platform system assembly 10 to be lowered.

Figure 6:
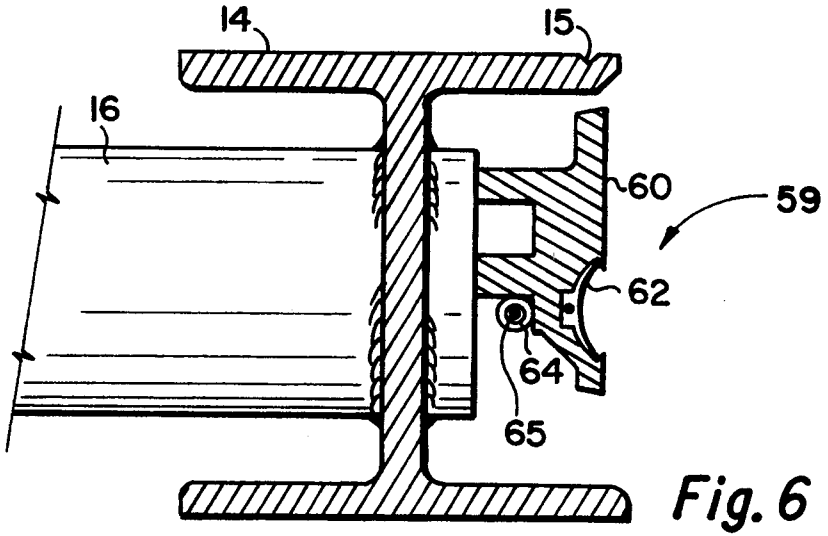
FIG. 6 is a partial sectional view of the movable tape measure taken along the line 6—6 of FIG. 2.
Figure 7:
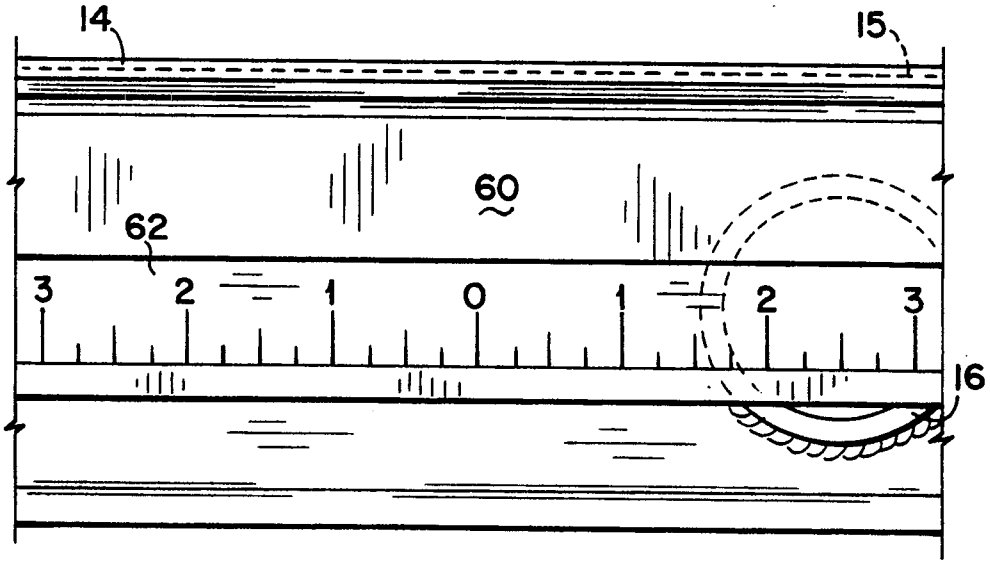
FIG. 7 is a partial elevational view taken along the line 7—7 of FIG. 2.
Figure 3:
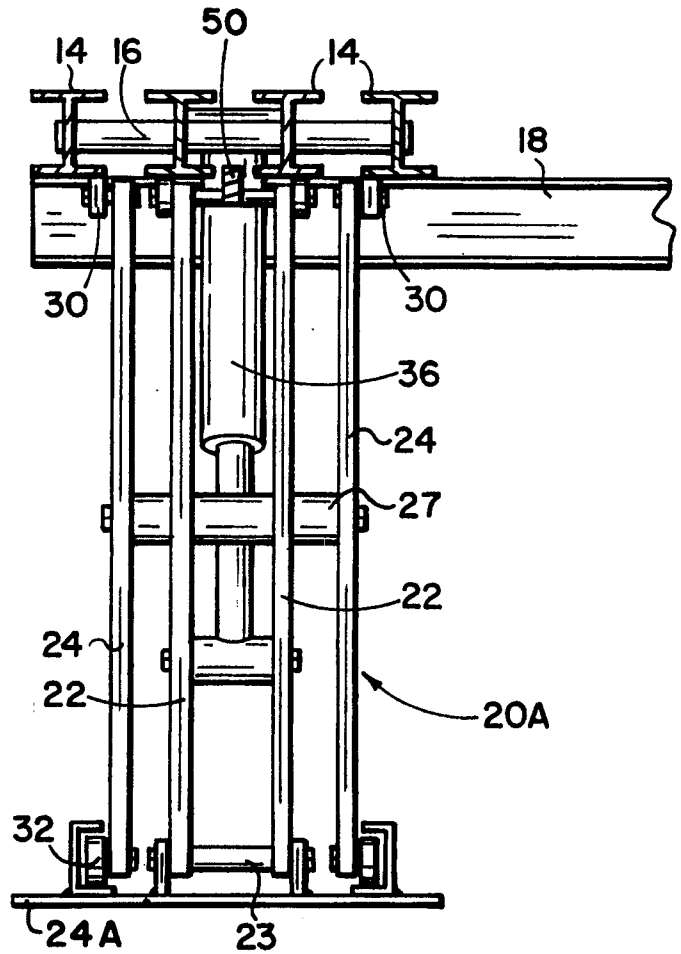
FIG. 3 is a sectional view taken along the line 3—3 of FIG. 1.
Figure 8:
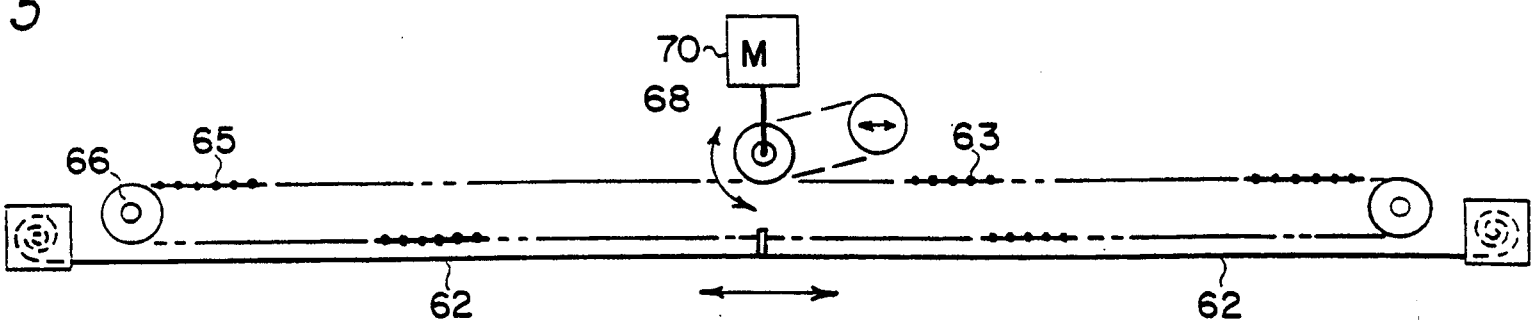
FIG. 8 is a schematic of the longitudinal measuring tape and mechanism for moving the tape.

FIGS. 6 and 7 are partial views of a longitudinally movable tape measuring device, generally designated by numeral 59, comprised of guide 60 which is attached to extensions of transverse tubing 16 along the longitudinal length 17B of the platform system assembly 10. Although the guide 60 is shown on the inside of the treadway 12A and 12B, it could also be positioned on the outside of the treadway 12A or 12B. Referring to the schematic in FIG. 8, a measuring tape 62 is exposed to the operator's view and is connected to a chain 63 forming an endless system driven by a source of power 70 which operates an attached drive sprocket 68. The endless system is wrapped around drive sprocket 68 and idler sprocket 66. A guide tube 64 is provided along the longitudinal length 17B for longitudinal movement of the measuring tape 62 during the processes described herein and in U.S. Pat. No. 5,058,286.

A V-groove 15 is provided along the longitudinal length 17B of one or more of the I-beams 14 and serves as a guide rail for cross members 18 and 20 used in measuring a vehicle (not shown). (See FIGS. 13A and 13B.)

VEHICLE CENTERING

Figure 9:
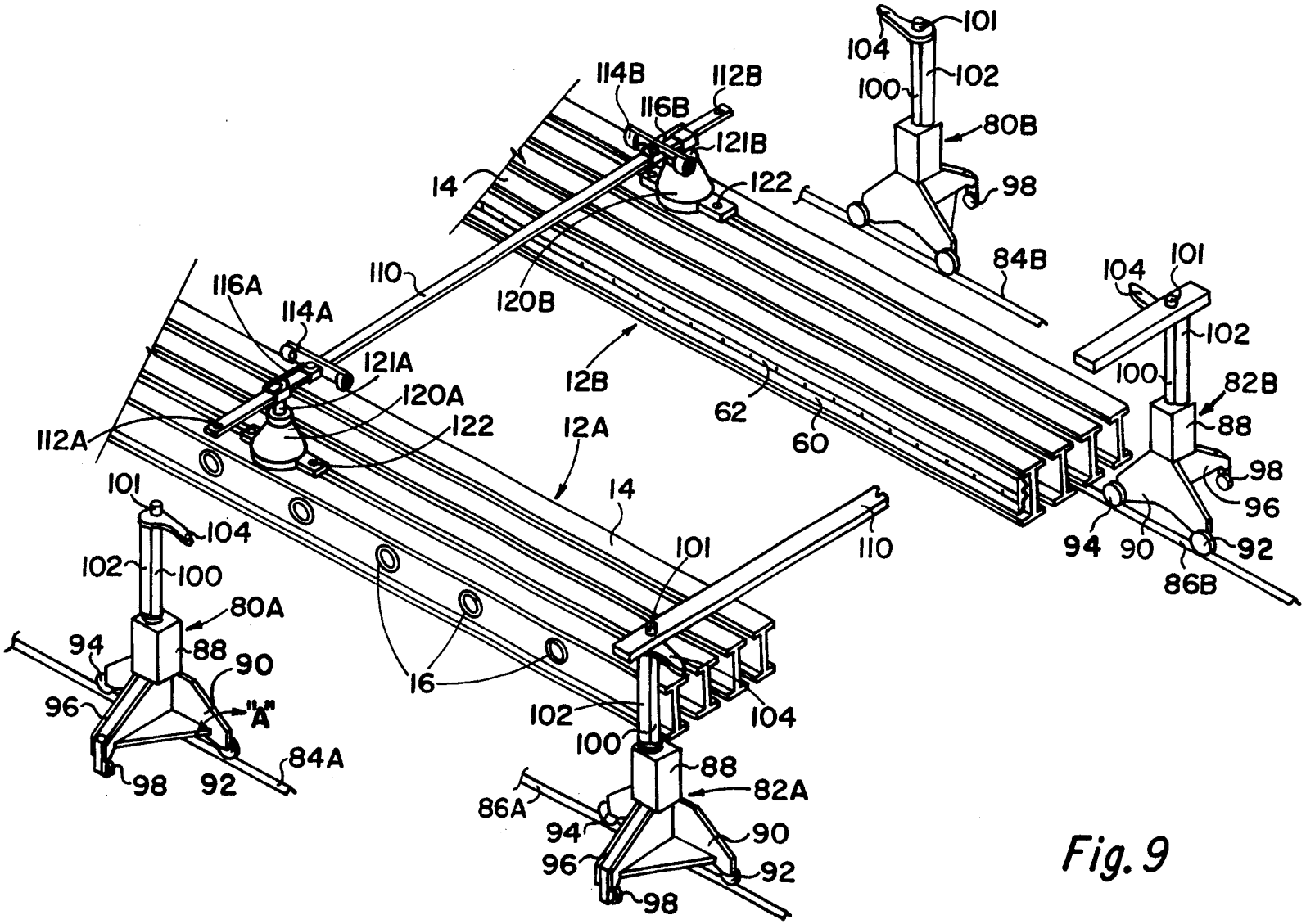
FIG. 9 is a perspective view of vehicle centering means as used in this invention.
Figures 10, 11:
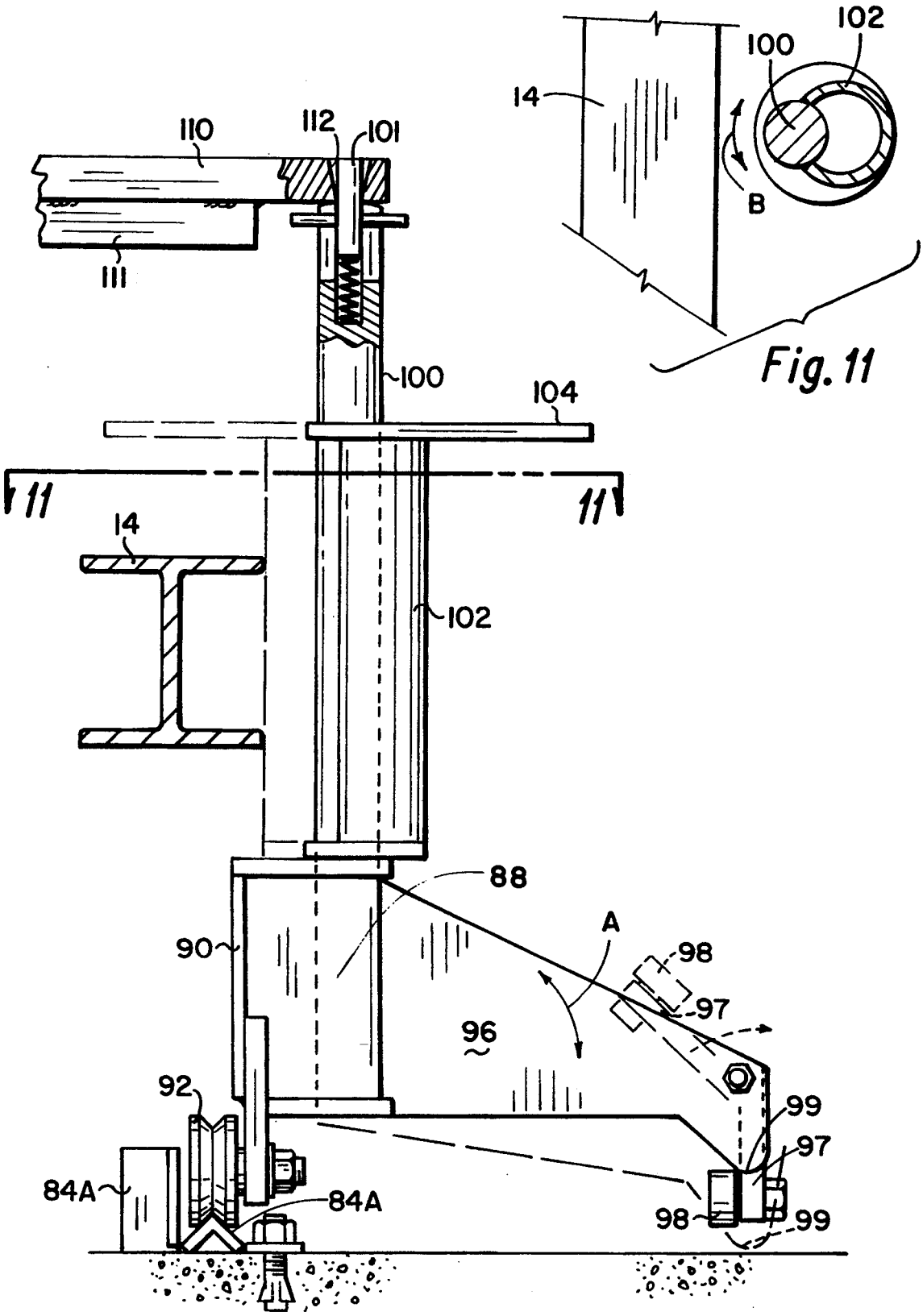
FIG. 10 is a front elevation view of a centering stand of this invention.
FIG. 11 is a sectional view taken along the line 11—11 of FIG. 10.

FIGS. 9, 10, 11 herein represent one form of means for centering the vehicle (not shown) relative to the platform system assembly 10. The means for centering, i.e., a centering assembly, comprises two pair of stands, generally designated as first pair 80 comprised of stands 80A and 80B and second pair 82 comprised of stands 82A and 82B. Each stand 80A, 80B, 82A, and 82B is supported upon a floor guide rail 84A, 84B, 86A and 86B respectively. Each of the centering stands 80A, 80B, 82A and 82B is identical and like numbers are used hereafter for like parts. Basic centering frame 88 includes longitudinal member 90 supported upon the respective guide rails 84A, 84B, 86A, and 86B by rollers 92 and 94 which provide a pivotal action of the centering frame 88 as shown by the arrows "A" on FIGS. 9 and 10. A transverse frame 96 includes a pivotal pedestal 98 (See FIG. 10) in order to limit the rocking motion of the centering frame 88. Vertically supported to the centering stand frame 88 is a centering camshaft 100 and its associated cam member 102 which is rotatable by the cam actuating handle 104 in the direction shown by the arrows "B" in FIG. 11. Camshaft 100 extends above the actuating handle 104 exposing the interlocking pin 101. Associated with each centering stand 80A, 80B, 82A and 82B is vehicular support bar 110 which includes opening 112A at one end and 112B at the other end. Openings 112A and 112B are engaged by the interlocking pins 101. Slidably positioned on the vehicular support bar 110 are commonly known vehicular pinch weld type clamps 114A and 114B which are transversely adjustable by respective threaded bolts 116A and 116B. (See U.S. Pat. No. 5,058,286.) The vehicular support bar 110 is supported within each treadway 12A and 12B by jack stands 120A and 120B, including bolts 122 for ultimate clamping of the vehicular support bar 110 to the treadways 12A and 12B.

In operation, once the vehicle (not shown) has been placed upon the treadways 12A and 12B of the platform system assembly 10, vehicular support bars 110 are positioned beneath the vehicle (not shown) at the appropriate places where the pinch weld-type clamps 114A and 114B or other types of vehicle body clamps (not shown) can be attached to chassis members (not shown) of the vehicle (not shown), both forwardly and rearwardly. The clamps 114A and 114B may be moved inwardly or outwardly by rotation of the threaded bolt members 116A and 116B as needed for the particular vehicle size. Once the vehicle has been clamped to the vehicular support bars 110, lift mechanisms, i.e., scissor jacks 20A and 20B, are actuated to raise the vehicle (not shown) a sufficient height above the centering stands 80A, 80B, 82A, and 82B. The centering stands 80A, 80B, 82A and 82B are then positioned such that interlocking pin 101 will be located within respective openings 112A and 112B of each vehicular support bar 110. The lift mechanisms and the platform system assembly 10 are then lowered, leaving the vehicle (not shown) now suspended upon the centering stands 80A, 80B, 82A, and 82B. Because the centering stands 80A, 80B, 82A and 82B are pivotal as shown by the arrow "A" in FIGS. 9 and 10, the interlocking pin 101 can easily be positioned within the respective openings 112A and 112B. However, the vehicle (not shown) still may not be centered, i.e., a longitudinal center axis (not shown) of the vehicle (not shown) is not in alignment with a longitudinal center axis 118 of the platform system assembly 10. (See FIG. 2.) By rotation of handles 104, the cams 102 of each stand 80A, 80B, 82A and 82B will ride against the outside edge of the guide rail I-beam 14 of each treadway 12A and 12B such that the centering stands 80A, 80B, 82A and 82B will be in a vertical position such as shown in FIG. 10. At this point, the vehicle (not shown) is now centered longitudinally relative to the platform system assembly 10, i.e. the longitudinal center axis (not shown) of the vehicle (not shown) lies within a vertical plane that also includes the longitudinal center axis 118 of the platform system assembly 10. Leveling support jack stands 120A and 120B are then affixed to the treadways 12A and 12B using bolts 122. Further leveling of the vehicle occurs as needed by the operation of screw jacks 121A and 121B which are provided on the jack stands 120A and 120B respectively. The platform system assembly 10 is then raised further so that the interlocking pins 101 can be removed from the respective openings 112A and 112B, permitting the centering stands 80A, 80B, 82A and 82B to now be removed from the platform system assembly 10 and leaving the vehicle (not shown) supported and centered upon the platform system assembly 10 for further measuring and repairing as needed.

MEASURING SYSTEM

Figure 12:
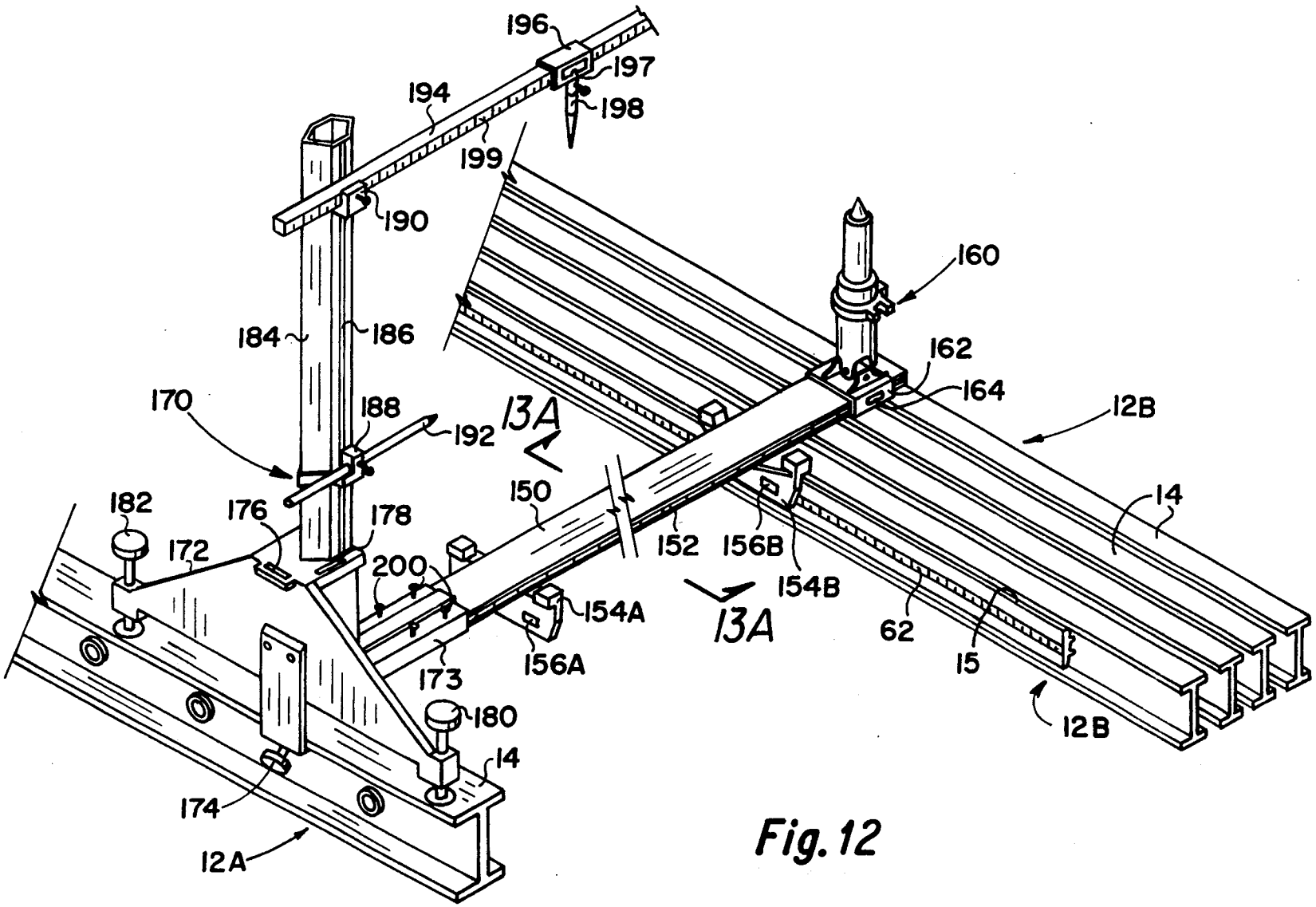
FIG. 12 is a perspective view of one form of measuring system for use with the platform system assembly.
Figure 13A:
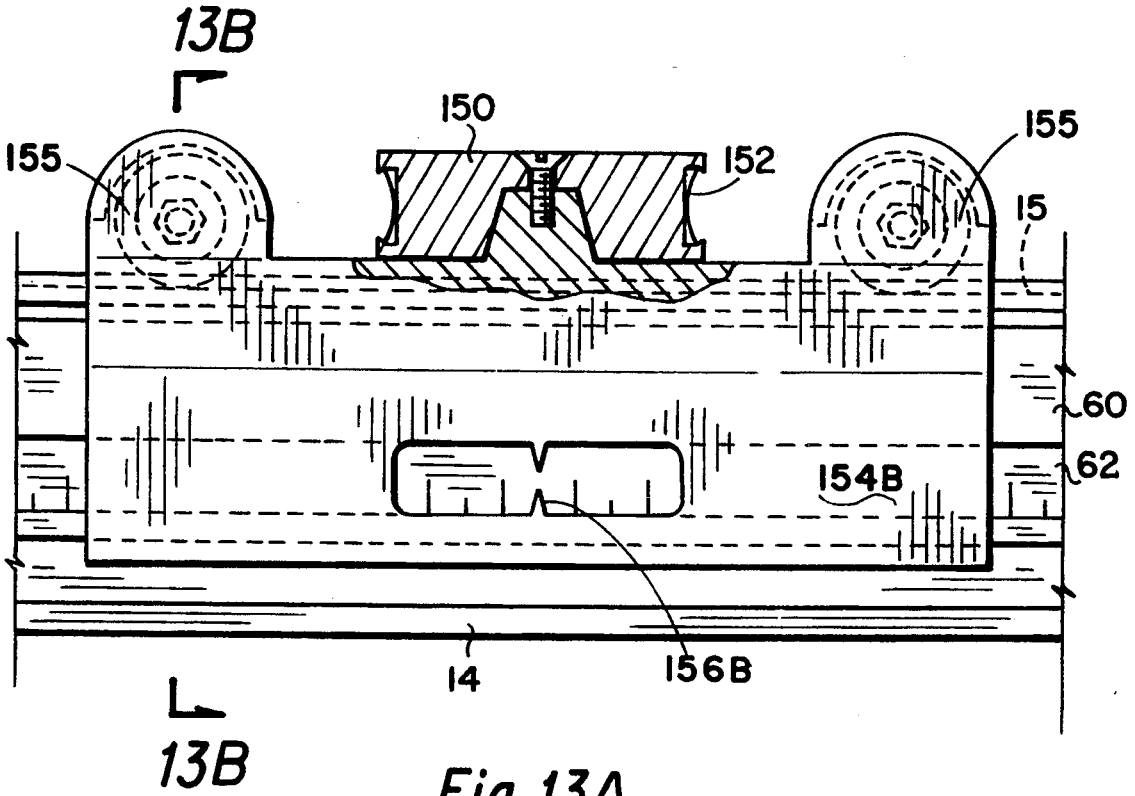
FIG. 13A is a partial sectional view taken along line 13A—13A of FIG. 12.
Figure 13B:
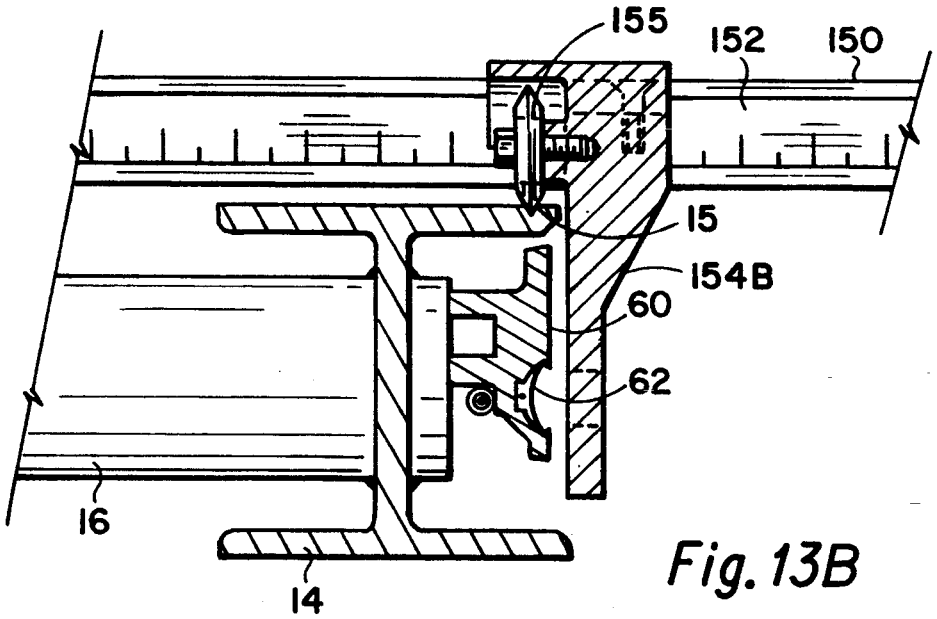
FIG. 13B is a sectional view taken along line 13B—13B of FIG. 13A.

Referring now to FIGS. 12, 13A and 13B, one form of measuring system is depicted. This system comprises a measuring cross track 150 which extends transversely across treadways 12A (not shown) and 12B of the platform system assembly 10. The measuring cross track 150 includes a transverse tape measuring indicia 152 on one or both sides thereof. The measuring cross track 150 is retained within supports 154A and 154B and rests on wheeled members 155 which ride within V-groove 15 (see FIG. 6). Each of the supports 154A and 154B includes a window 156A and 156B that provides a pointer for alignment with the measuring tape 62. A vertical measuring pointer generally designated by the numeral 160 is supported upon slide member 162 which is adapted to slide transversely along the crossbar 150 to make contact with various measuring points of a vehicle. The slide member 162 includes an indicia marker 164 to act as a pointer for alignment with the tape measuring indicia 152 and thus give transverse measurements of particular points on the vehicle (not shown) in order to determine the alignment thereof relative to the manufacturer's specifications. Although one vertical measuring pointer 160 is shown, a plurality could be used upon the measuring cross track 150.

An upper body measuring means is shown and generally designated by the numeral 170 and includes an upright base 172 which can be clamped to the I-beam 14 by clamp screw 174. Appropriate levels 176 and 178 are provided as a part of the base 172 while leveling screws 180 and 182 provide means along with clamp screw 174 for leveling the upper body measuring means 170. An upright measuring bar 184 is vertically movable within the upright base 172 and includes a measurement tape 186 to which holders 188 and 190 may be clamped into position, each holding respective offset pointer 192 and overhead crossbar 194. The overhead crossbar 194 includes an overhead pointer holder 196 having an overhead pointer 198 attached thereto. The overhead pointer holder 196 also includes indicia pointers 197 to provide measuring indication relative to an overhead tape 199 provided on the overhead crossbar 194. The upright base 172 includes a horizontal support member 173 which will telescope relative to measuring cross track 150. The measuring cross track 150 is secured to the horizontal support member 173 by means of a plurality of set screws 200 provided on the horizontal support member 173.

PULLING SYSTEM

One of the key aspects of the invention is the universal nature of the platform system assembly 10 which makes it applicable to a variety of uses relative to vehicle maintenance and repair. One of those applications is the acceptability by the platform system assembly 10 of a mechanism for repairing collision damaged vehicles utilizing pull towers which may be oriented virtually at any place around the vehicle. One such pulling tower is shown in FIGS. 14–20, the pulling tower being generally designated by the numeral 210. The tower comprises a lower base portion 212 and a vertical upright portion 214, the latter containing a pulling mechanism. At an end of the lower support 212 is a flange 216 which is rotatably connected to a notched base flange 218 by an interlock device 220 and a keeper 221. The notched base flange 218 includes a sleeve 222 of square configuration which non-rotatably nests between flanges of the I-beam 14. A securing bracket 224 is connected by welding or other suitable means to the notched base flange 218 and is strengthened by a gusset 226. A threaded bolt 228 clamps the securing bracket 224 to a flange of the I-beam 14.

Figure 14:
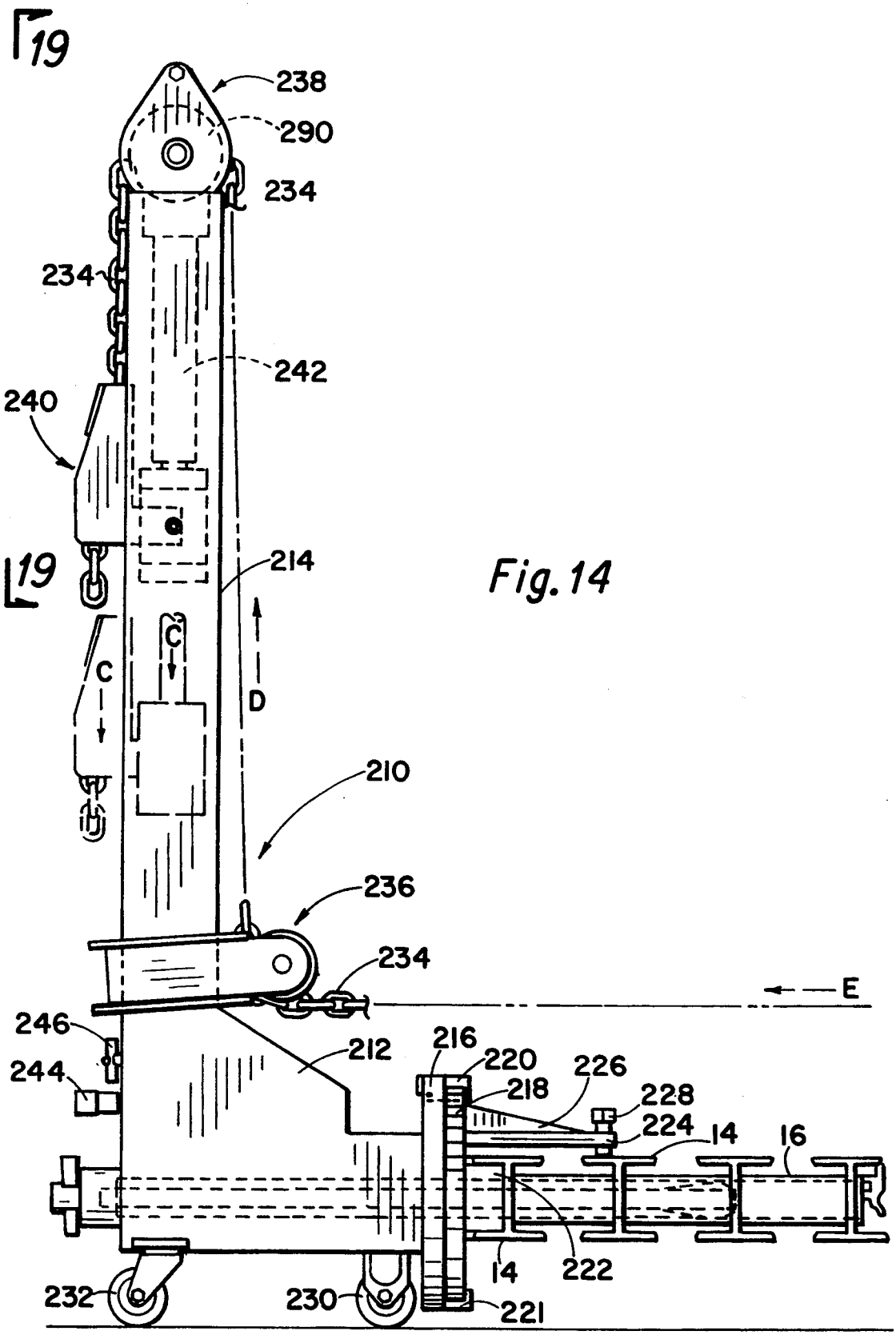
FIG. 14 is a side elevation view of the pulling tower of this invention.
Figure 16:
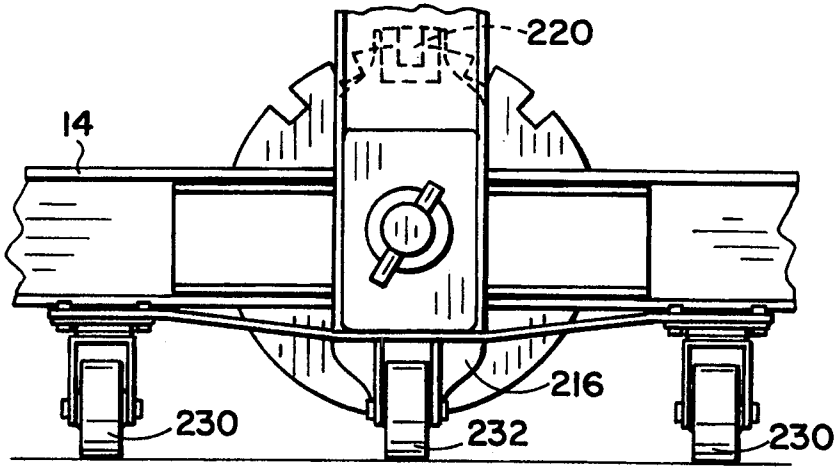
FIG. 16 is a partial back view of the pulling tower taken along the line 16—16 of FIG. 15.
Figure 15:
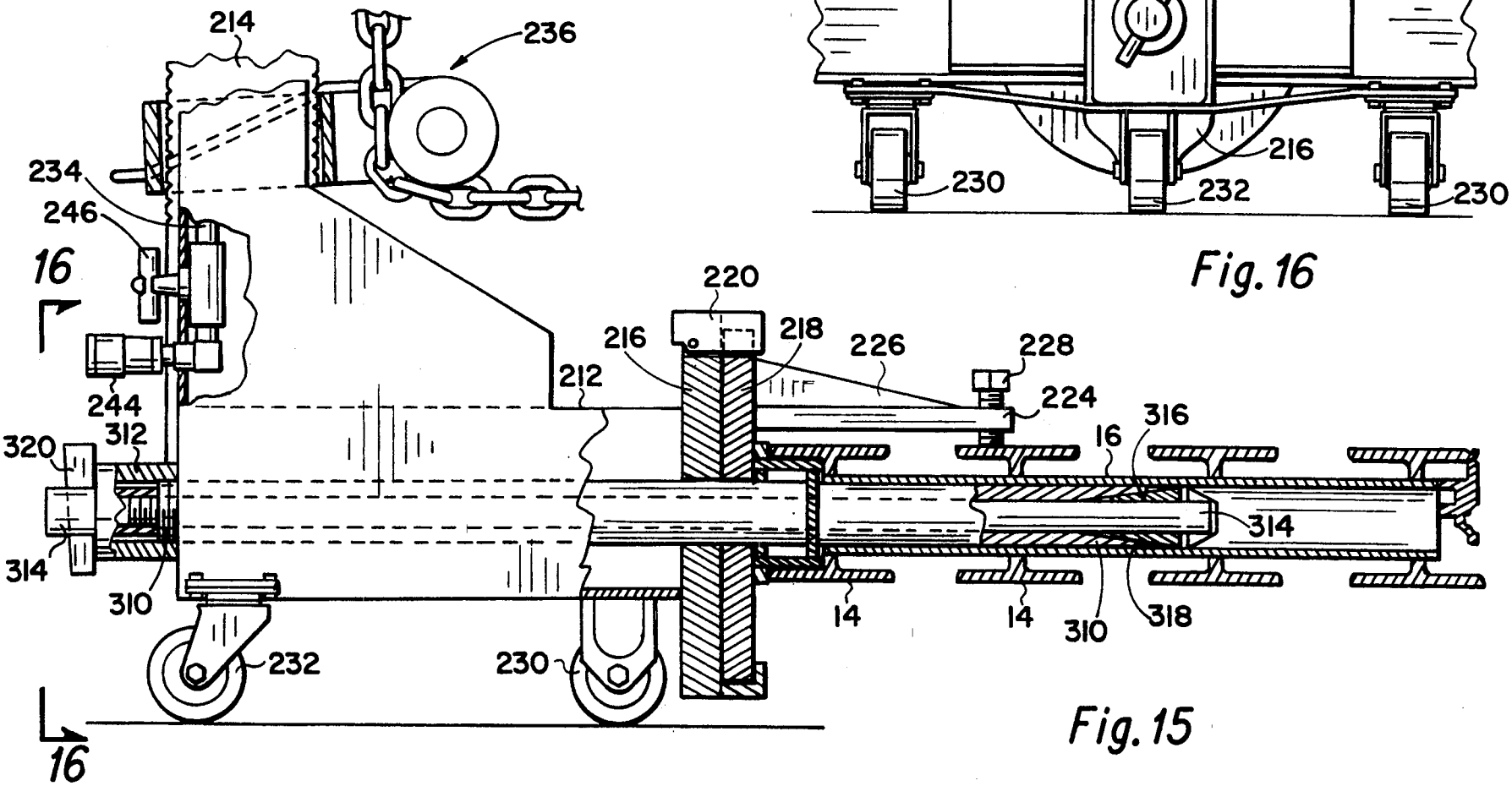
FIG. 15 is a side view partly in section depicting the lower base portion of one form of pulling tower and its connection to the platform system assembly.

The pulling tower 210 includes fixed caster wheels 230 and pivotal caster wheels 232 to permit the pulling tower 210 to be rolled into place for affixing to the I-beams 14 of platform treadways 12A and 12B via transverse tubing 16. The interconnection of the pulling tower 210 to the I-beam 14 and the tubing 16 is best shown in FIGS. 15 and 16. The pulling force is achieved (see arrows "C", "D" and "E" in FIG. 14) through a cable or a chain 234 extending horizontally from the vehicle (not shown) through an idler system generally designated by the numeral 236, thence upwardly around an upward sheave assembly generally designated by the numeral 238, thence downwardly to a chain locking mechanism generally designated by the numeral 240. The chain locking mechanism 240 is more particularly illustrated in FIGS. 19 and 20, but it is generally adapted to apply pulling force by movement vertically downward by a fluid powered cylinder/piston assembly 242 as shown by the dotted lines. Hydraulic power to the cylinder/piston assembly 242 is connectable to a conduit (not shown) via a connection port 244 and is controlled by a valve 246.

Figure 18:
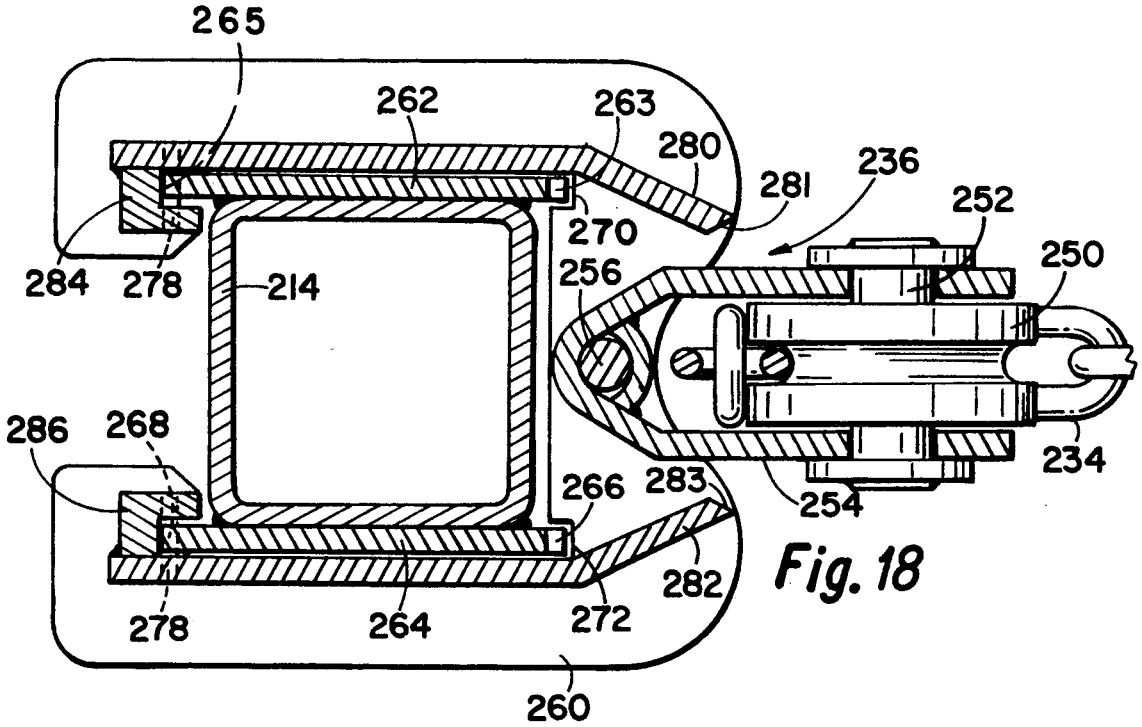
FIG. 18 is a top sectional view of the chain location collar taken along the line 18—18 of FIG. 17.
Figure 17:
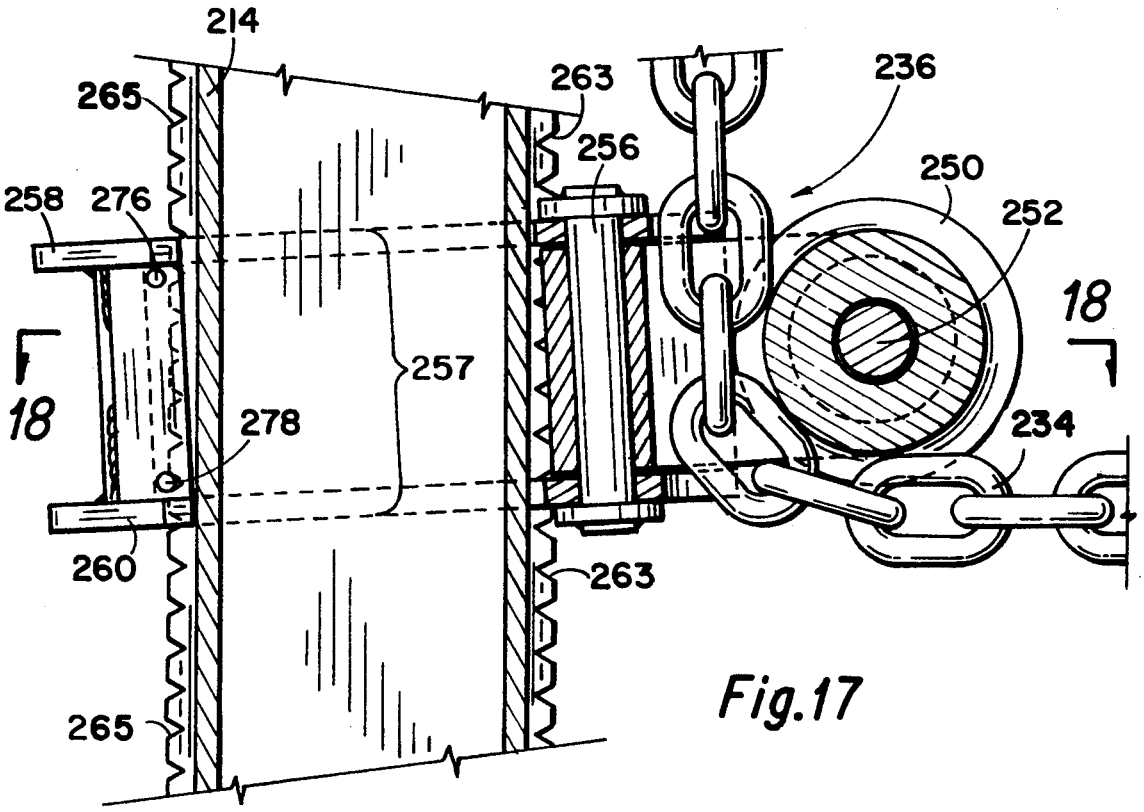
FIG. 17 is a partial section view of the chain location collar.

Referring now to FIGS. 17 and 18, the idler system 236 is specifically shown relative to its position on the vertical upright portion 214 of the pulling tower 210. An idler pulley 250 is rotatably supported about shaft 252 which is secured to a yoke member 254. The yoke member 254 is capable of a swivel motion about pivot shaft 256 which is connected to a chain location collar 257 comprised of an upper collar 258 and a lower collar 260. The upper and lower collars 258 and 260 extend around the vertical upright portion 214 of the pulling tower 210 as a means of securing the idler system 236 thereto. The vertical upright portion 214 of the pulling tower 210 is provided with a front side 259 which faces toward the platform system assembly 10 and an opposite back side 261. The vertical upright portion 214 includes parallel side plates 262 and 264 which include, respectively, forward notches 263 and rearward notches 265 for the plate 262 and forward notches 266 and rearward notches 268 for the plate 264. The forward notches 263 and 266 interlock with the upper collar 258 and the rearward notches 265 and 268 interlock with the lower collar 260 as shown in FIG. 17 when a pulling force applied to the chain 234 causes the idler system 236 to cant, allowing notched portions 270 and 272 located on each of the collars 258 and 260 to interlock with the forward notches 263 and 266.

As shown in FIGS. 17 and 18, upper and lower pins 276 and 278 will interlock within the respective rearward notches 265 and 268 thus retaining the idler system 236 in a fixed position, i.e., preventing it from sliding up or down the pulling tower 210 during the pulling operation. To keep the yoke member 254 from pivoting farther than a safe angle, guide plates 280 and 282 located between collars 258 and 260 include angled stops 281 and 283. Rearwardly, as shown in FIG. 18, keeper plates 284 and 286 retain the collars 258 and 260 along the plates 262 and 264 and also retain the upper and lower pins 276 and 278.

Figure 19:
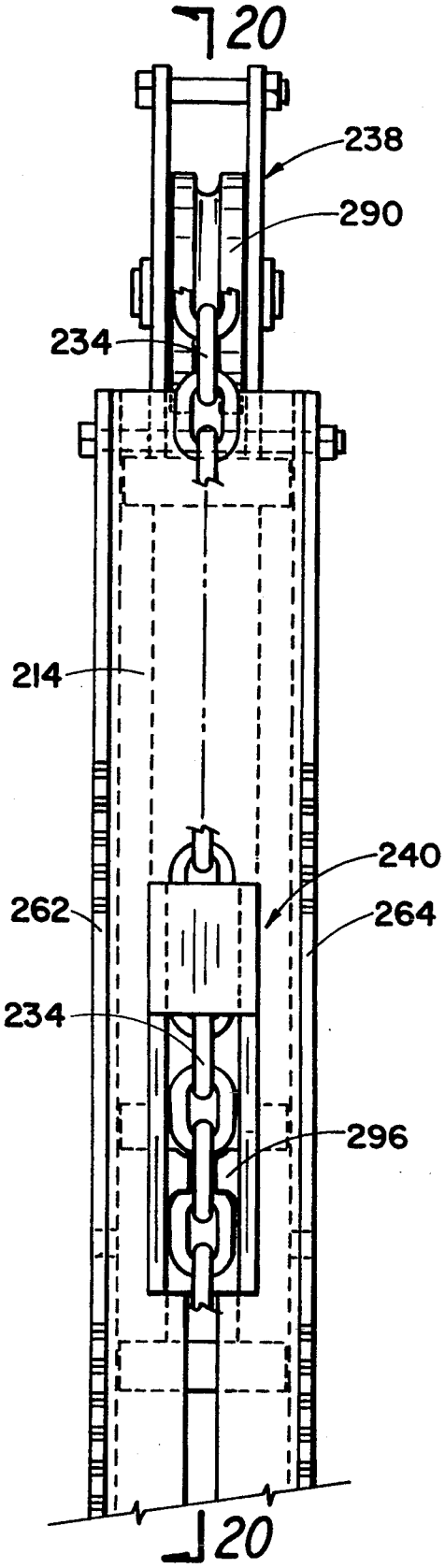
FIGS. 19 and 20 are respective partial back and side views of the vertical upright portion of the pulling tower.
Figure 20:
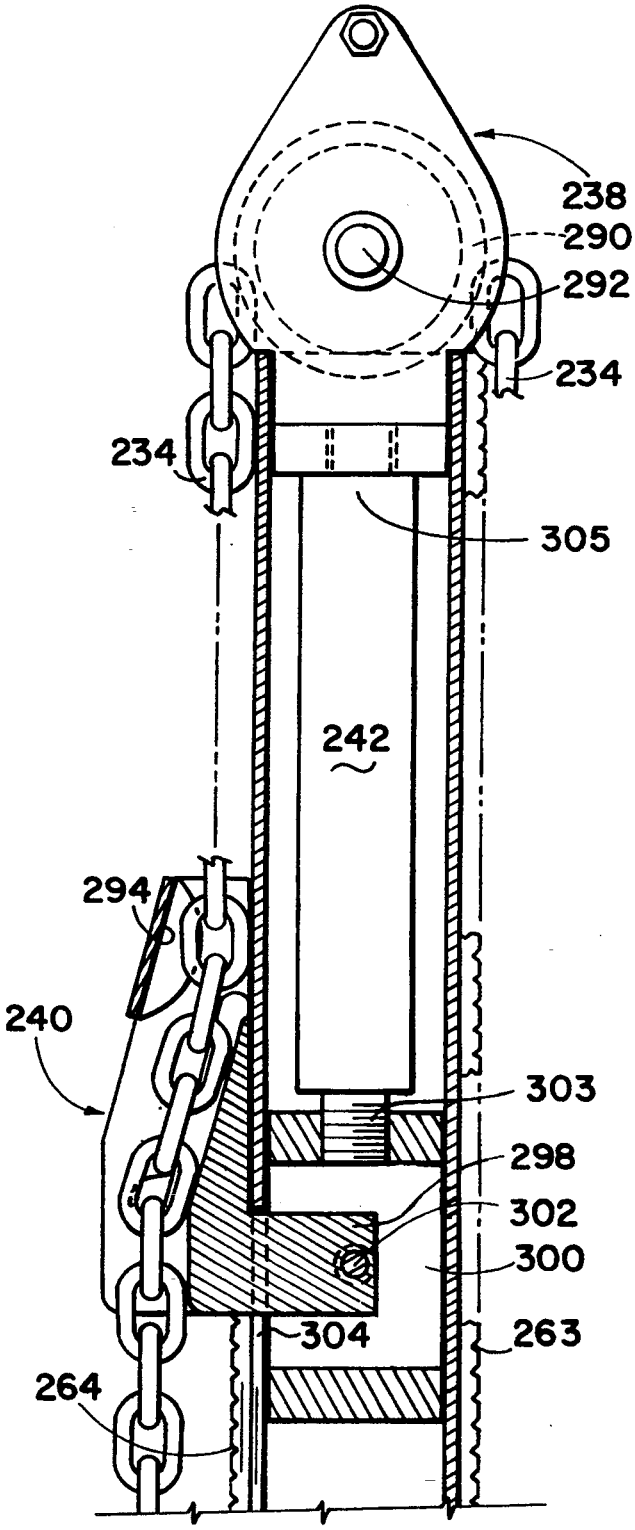

Referring now to FIGS. 19 and 20, the vertical upright portion 214 of the pulling tower 210 and pulling mechanism is best shown. The chain 234 will pass upwardly and around an idler sheave 290 which is supported on a top of the vertical upright portion 214 of the pulling tower 210 and which is adapted to rotate about shaft 292. The chain 234 will then pass downwardly into the chain locking mechanism 240. The chain locking mechanism 240 includes a passageway 294 through which the chain 234 may pass. The chain is interlocked, as best shown in FIG. 19, with a notched block 296 which retains one link of the chain 234 in a transverse position while supporting the next adjacent links above and below. The chain locking mechanism is provided with an L-shaped bar 298 which attaches to a hydraulically actuated member 300 by means of a bolt 302. The hydraulically actuated member 300 attaches to a movable end 303 of the fluid powered cylinder/piston assembly 242. An opposite immovable end 305 of the fluid powered cylinder/piston assembly 242 is attached to the pulling tower 210. When the hydraulically actuated member 300 is forced downward by hydraulic pressure in the fluid powered cylinder/piston assembly 242, the L-shaped bar 298 passes through slot 304 in the direction of arrow "C" as illustrated in FIG. 14. Once tension in the chain 234 is removed, extra slack is taken up by removing the chain 234 from the notched block 296 and shortening or lengthening the chain 234 as needed and then re-locking it in position on the notched block 296 as shown in FIGS. 19 and 20.

The pulling tower 210 is interlocked with the platform system assembly 10, as best shown in FIG. 15, by an inner cylindrical barrel 310 which exits at the rear of the pulling tower through a cylindrical sleeve 312. A shaft 314 extends the length of the barrel 310 and includes on one end a cylindrical wedge member 316 which cooperates with a tapered portion 318 of the barrel 310. On the other end of the shaft 314, a taper 320 inserts into an opening provided in the shaft 314. The application of the taper 320 at the back end of the pulling tower 210 will force the cylindrical wedge member 316 and the barrel 310 into tight engagement with the interior conduit 17 of the tubing 16. Release of the pulling tower 210 is accomplished by hammering the taper 320 in the opposite direction and thus relieving that clamping pressure.

Figure 22:
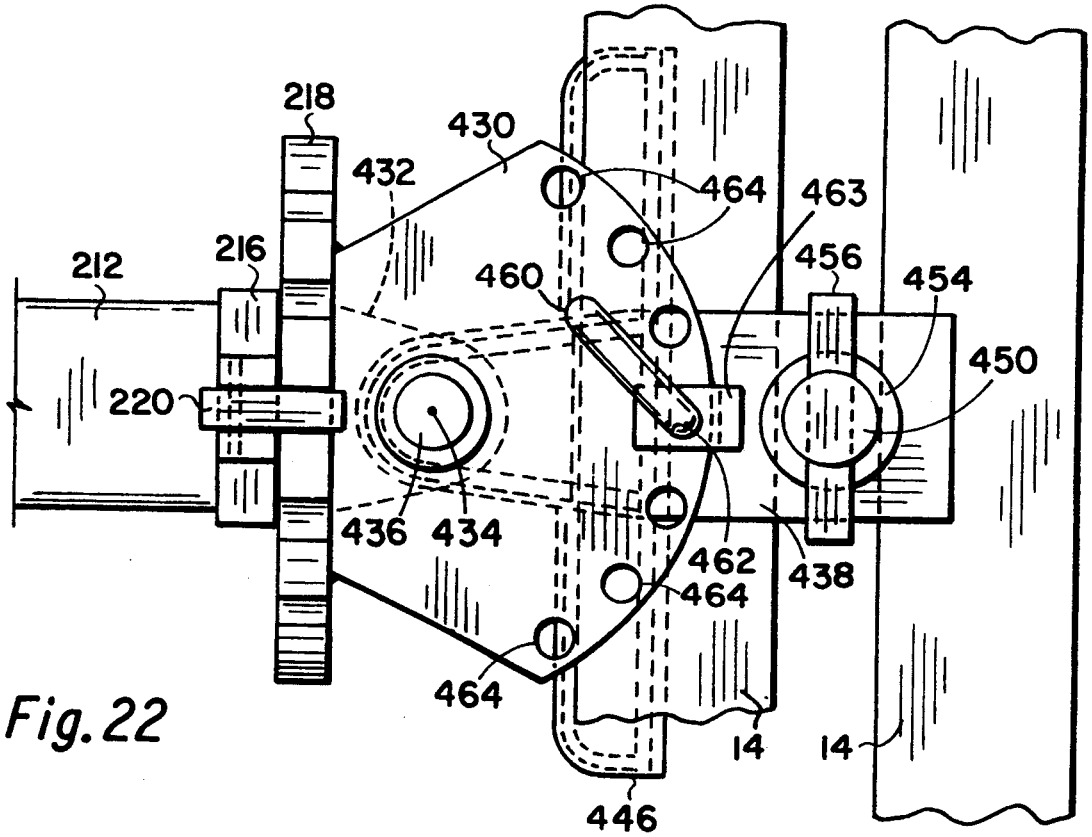
FIG. 22 is a top elevation of the means shown in FIG. 21.
Figure 21:
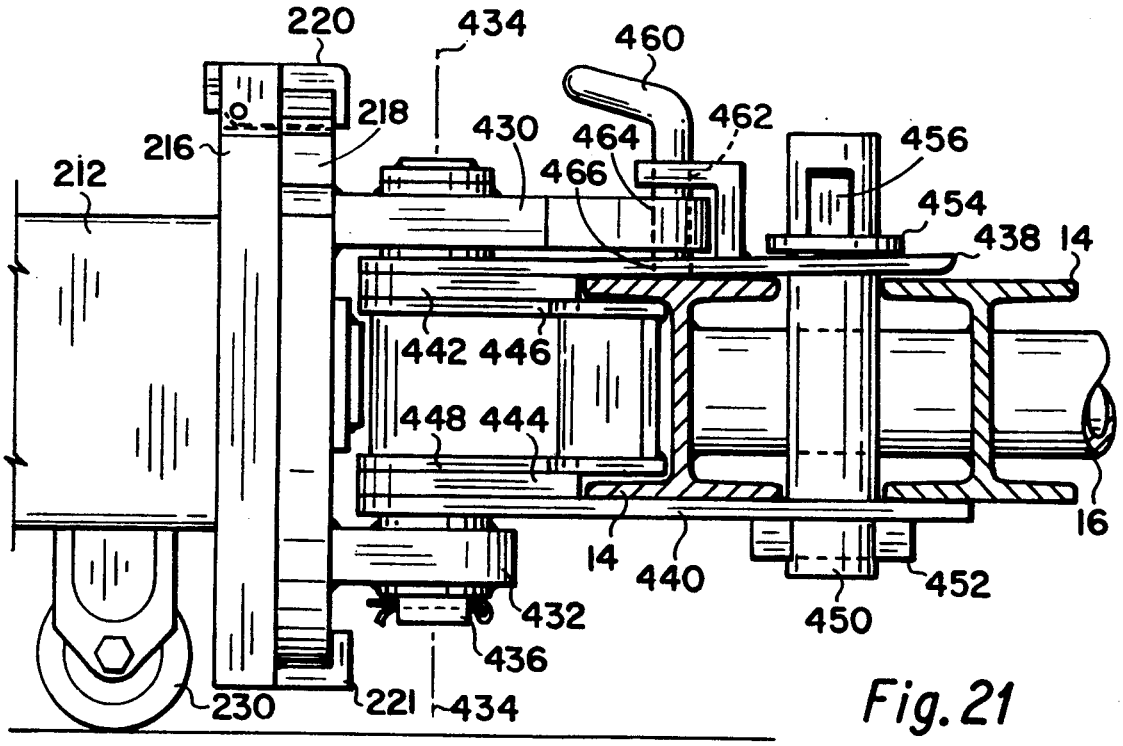
FIG. 21 is a partial side elevation of an alternate means to attach the pulling system to the platform system assembly.

Referring now to FIGS. 21 and 22, an optional form of attachment is provided for the pulling tower 210. This embodiment is adapted to be attached on the platform system assembly 10 at any point other than where the tubing 16 is fastened. The embodiment comprises upper and lower bearing plates 430 and 432 defining a central, pivotal axis 434 provided by a shaft 436 that permits the pulling tower 210 to be angularly rotated in a horizontal plane about the axis 434. The lower base portion 212 of the pulling tower 210 is clamped to the I-beam 14 of the platform system assembly 10 by an upper clamp plate 438 and a lower clamp plate 440. An inner support structure comprised of welded plates 442, 444, 446, and 448 are adapted to nest between the flanges of the I-beam members 14.

The pulling tower 210 is retained by a pin 450 that is adapted to be received within openings, holes, spaces, etc. from a top of the I-beams to a bottom thereof and retained by a bottom key 452 on the bottom side and a washer 454 on the top side. A tapered swage 456 locks the pulling tower 210 to the I-beams 14. The pulling tower 210 is retained at a variety of angular positions by a second pin 460 that drops through opening 462 in a cleat 463, thence through the chosen opening of openings 464 of the upper plate 430. The pivotal motion is around axis 434. The pin 460 then drops into lower opening 466 to retain the angular position of the pulling tower 210.

What is claimed is:

1. Apparatus for supporting, measuring and correcting a defective body and frame of a vehicle comprising:

a platform system assembly to receive said vehicle, said platform system assembly comprised of a pair of connected, spaced, and parallel longitudinal treadways, each said treadway comprised of spaced longitudinal and parallel I-beam members retained together by a plurality of transverse tubes, said tubes being open to outer perimeters of said treadways;

means for raising, lowering and releasably locking said platform system assembly at a desired height;

a measuring tape longitudinally movable along at least one of said treadways, means to move said measuring tape;

at least two centering assembles, each centering assembly comprising a vehicular support bar transversely positionable to said platform system assembly, said vehicular support bar having means to connect with chassis members of said vehicle, outer ends of said support bar supported upon stands, each said stand having a track means to move said stand longitudinally with respect to said platform system assembly and to permit pivotal movement of said stand transverse to said platform, cam means operable against said outer perimeter of said treadways to position a longitudinal center axis of said vehicle within a vertical plane which also includes a longitudinal center axis of said platform system assembly;

a pulling tower having a vertical upright portion, said vertical upright portion being attached to a wheel supported lower base portion, a shaft means in said lower base portion receivable within one of said tubes of said platform system assembly, means to lock said shaft in said tube, means to rotate said pulling tower about said shaft to angularly position said pulling tower in a vertical plane relative to said platform system assembly, said pulling tower being provided with a front side and a back side, a plurality of vertical ratchet notches on the front and back sides of the pulling tower to lockably receive a collar, an idler pulley being attached to said collar so that it attaches on the front side of the pulling tower, an idler chain sheave being attached to a top of said pulling tower, a chain locking means vertically movable along said back side, a fluid powered cylinder/piston assembly powered by means in said tower, an immovable end of said cylinder/piston assembly connected to said pulling tower, a movable end of said cylinder/piston assembly connected to said chain locking means for vertical down/up movement, a pull chain connectable at one end to the vehicle positioned on said platform system assembly, thence around said idler pulley, thence around said idler sheave to said chain locking means at another end of said chain; and means to support said vehicle upon said platform system assembly.

2. Apparatus for supporting, measuring, and correcting a defective body and frame of a vehicle comprising:

a platform system assembly to receive said vehicle, said platform system assembly comprised of a pair of connected, spaced, and parallel longitudinal treadways, each said treadway comprised of spaced longitudinal and parallel beam members retained together by a plurality of transverse tubes, said tubes being open to outer perimeters of said treadways;

means for raising, lowering and releasably locking said platform system assembly at a desired height;

at least two centering assemblies, each centering assembly comprising a vehicular support bar transversely positionable to said platform system assembly, said vehicular support bar having means to connect with chassis members of said vehicle, outer ends of said support bar supported upon stands, each said stand having a track means to move said stand longitudinally with respect to said platform system assembly and to permit pivotal movement of said stand transverse to said platform, cam means operable against said outer perimeter of said treadways to position a longitudinal center axis of said vehicle within a vertical plane which also includes a longitudinal center axis of said platform system assembly.

3. Apparatus for supporting, measuring, and correcting a defective body and frame of a vehicle comprising:

a platform system assembly to receive said vehicle, said platform system assembly comprised of a pair of connected, spaced and parallel longitudinal treadways, each said treadway comprised of spaced longitudinal and parallel beam members retained together by a plurality of transverse tubes, said tubes being open to outer perimeters of said treadways;

means for raising, lowering and releasably locking said platform system assembly at a desired height;

a vertical pulling tower attached to a wheel supported lower base portion, a shaft means in said lower base portion receivable within one of said tubes of said platform system assembly, means to lock said shaft in said tube, means to rotate said pulling tower about said shaft to angularly position said pulling tower in a vertical plane, said pulling tower being provided with by a front side and a back side, a plurality of vertical ratchet notches being provided on the front and back sides of the pulling tower to lockably receive a collar, an idler pulley being attached to said collar so that it attaches on the front side of the pulling tower, an idler sheave being attached to a top of said pulling tower, a chain locking means vertically movable along said back side, a fluid powered cylinder/piston assembly powered by means in said pulling tower, an immovable end of said cylinder/piston assembly connected to said pulling tower, a movable end of said cylinder/piston assembly connected to said chain locking means for vertical down/up movement, a pull chain connectable at one end to the vehicle positioned on said platform system assembly, thence around said idler pulley, thence around said idler sheave to said chain locking means at its other end.

4. A vehicle pull tower comprising:

a vertical upright portion being attached to a wheel supported lower base portion, a shaft means in said lower base portion receivable within a tube formed as a part of a vehicle supporting platform system assembly; means to lock said shaft means in said tube, means to rotate said pulling tower about said shaft to angularly position said pulling tower about a vertical plane relative to said platform system assembly, said pulling tower being provided with a front side and a back side, a plurality of vertical ratchet notches being provided on the front and back sides of the pulling tower to lockably receive a collar, an idler pulley being attached to said collar so that it attaches on the front side of the pulling tower, an idler sheave being attached to a top of said pulling tower, a chain locking means vertically movable along said back side, a fluid powered cylinder/piston assembly powered by means in said tower, an immovable end of said cylinder/piston assembly connected to said pulling tower, said cylinder/piston assembly connected to said chain locking means for vertical down/up movement, a pull chain connectable at one end to the vehicle positioned on said platform system assembly, thence around said idler pulley, thence around said idler sheave to said chain locking means at its other end.

5. Apparatus for supporting, measuring and correcting a defective body and frame of a wheeled vehicle comprising:

a floor supported platform system assembly to receive said vehicle, said platform having parallel treadways to receive said wheels of said vehicle;

means for raising, lowering and releasably locking said platform system assembly at a desired height; and centering means positioned on said floor and unconnected to said platform to lift, support and movably position a longitudinal centerline of said vehicle relative to and coincident with a longitudinal center axis of said platform system assembly whereby measurements can be made as to the extent of said defective body and frame relative to said longitudinal center axis said centering means comprises:

at least two centering assembles, each centering assembly comprising a vehicular support bar transversely positionable to said platform system assembly, said vehicular support bar having means to connect with chassis members of said vehicle, outer ends of said support bar supported upon stands, each said stand having a track means to move said stand longitudinally with respect to said platform system assembly and to permit pivotal movement of said stand transverse to said platform, cam means operable against said outer perimeter of said treadways to position said longitudinal center axis of said vehicle within a vertical plane which also includes said longitudinal center axis of said platform system assembly.

6. Apparatus of claim 5 wherein each said treadway is comprised of spaced longitudinal and parallel I-beam members retained together by a plurality of transverse tubes, said tubes being open to outer perimeters of said treadways.

7. Apparatus of claim 6 having a pulling tower capable of creating pulling forces to correct said defective vehicle body and frames, said tower interconnectable with one of said transverse tubes.

8. Apparatus of claim 7 wherein said pulling tower comprises:

a vertical upright portion, said vertical upright portion being attached to a wheel supported lower base portion, a shaft means in said lower base portion receivable within one of said tubes of said platform system assembly, means to lock said shaft in said tube, means to rotate said pulling tower about said shaft to angularly position said pulling tower in a vertical plane relative to said platform system assembly, said pulling tower being provided with a front side and a back side, a plurality of vertical ratchet notches on the front and back sides of the pulling tower to lockably receive a collar, an idler pulley being attached to said collar so that it attaches on the front side of the pulling tower, an idler chain sheave being attached to a top of said pulling tower, a chain locking means vertically movable along said back side, a fluid powered cylinder/piston assembly powered by means in said tower, an immovable end of said cylinder/piston assembly connected to said pulling tower, a movable end of said cylinder/piston assembly connected to said chain locking means for vertical down/up movement, a pull chain connectable at one end to the vehicle positioned on said platform system assembly, thence around said idler pulley, thence around said idler sheave to said chain locking means at another end of said chain; and means to support said vehicle upon said platform system assembly.

9. A method of correcting a defective portion of a body or frame of a wheeled vehicle comprising the steps of:

positioning said vehicle upon parallel treadways formed as a part of a platform system having means thereon to define a longitudinal centerline;

raising said platform to a desired height;

lifting said vehicle above said platform and adjusting same whereby a longitudinal center of said vehicle is coincident with said longitudinal centerline of said platform system;

lowering said vehicle onto said treadways and clamping said vehicle thereto;

measuring and comparing said defective portion of said body or frame based on an original dimensional standard for said vehicle relative to said longitudinal centerline of said platform system;

attaching to said platform means to push or pull said defective portion into an alignment as set forth by said original dimensional standard.

* * * * *